US006696629B1

(12) United States Patent
Cooper, Jr.

(10) Patent No.: US 6,696,629 B1
(45) Date of Patent: Feb. 24, 2004

(54) KEYLESS PLASTIC SAXOPHONE

(76) Inventor: Robert H. Cooper, Jr., 230 E. 48th St., (Apt. #54), New York, NY (US) 10017

( * ) Notice: Subject to any disclaimer, the term of this patent is extended or adjusted under 35 U.S.C. 154(b) by 0 days.

(21) Appl. No.: 10/191,189

(22) Filed: Aug. 17, 2002

(51) Int. Cl.[7] ..... G10D 7/68
(52) U.S. Cl. ..... 84/385 R
(58) Field of Search ..... 84/385 R, 383, 84/387 R, 383 R, 384

(56) References Cited

U.S. PATENT DOCUMENTS 3,789,721 A * 2/1974 Paladino ..... 84/380 R
5,736,662 A * 4/1998 Spector ..... 84/600
5,998,715 A * 12/1999 Rovner ..... 84/383 R

* cited by examiner

*Primary Examiner*—Kimberly Lockett

(57) ABSTRACT

A conically shaped, keyless plastic wind instrument with eight holes, consisting of a single body and a detachable a mouthpiece. The instrument is fully chromatic and capable of playing in any of the traditional twelve keys of Western music—producing notes through a player's vibration of a single reed affixed to a soprano saxophone type mouthpiece, and through the opening or closing of a plurality of tone holes along its length by use of the fingers. The instrument is one of a family of keyless saxophones which can be pitched in the alto, soprano, and soprano range by the lengthening or shortening of the body and by changing the location of the eight finger holes. By opening or closing the finger holes, the standing sound wave—created inside the instrument by the player's vibration of the reed affixed to the mouthpiece—is intersected at locations along the length of the body producing a vibration at a determined musical pitch, the scale of which is tuned to A=440, standard concert tuning. All members of this instrument family have the same fingering patterns, which are based on recorder (or vertical flute) fingerings.

15 Claims, 3 Drawing Sheets

KEYLESS PLASTIC SAXOPHONE

BACKGROUND

1. Field of Invention

Figure 1:
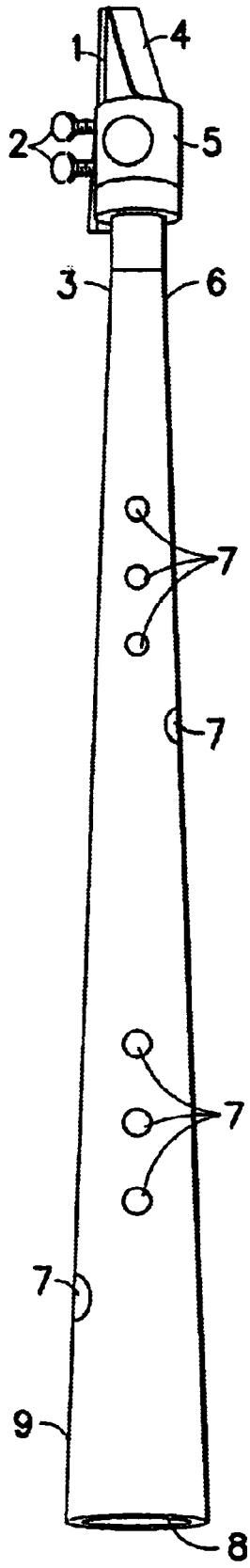

The invention relates to a keyless, lightweight plastic saxophone comprising a body with eight finger holes, coupled at its most narrow end to a single-reed mouthpiece and open at the opposite end, capable of being mass produced inexpensively and in various keys.

2. Description of Prior Art

The brass saxophone, used in marching bands and in many areas of popular music, was invented by the Belgian instrument maker Adolphe Sax in the 1840s. According to some music historians, the instrument was created by placing a bass clarinet style mouthpiece, to which a single reed was fastened by a metal ligature, onto a conically shaped brass horn called an ophicleide. The sound is produced when a performer vibrates the reed, generating a standing wave inside the instrument. Individual musical notes are produced through the manipulation of a system of metal keys and sprung rods, which open or close various tone holes along the length of the body, with the use of leather pads, and thereby intersect the sound wave at specific points to produce a desired pitch.

The modern saxophone family includes seven members: the sopranino in Eb, soprano in Bb, Alto in Eb, Tenor in Bb, Baritone in Eb, Bass in Bb, and Contrabass in Eb. Historically, the family has also included instruments pitched in C and F. All members of the family are produced in a curved configuration resembling the letter "J," and some of them—the sopraninos, sopranos, altos and tenors—are also produced in straight models.

The saxophone is unusual among musical instruments in that it has remained largely unchanged since its invention. Keys have been added to facilitate the playing of certain notes, and improvements have been made in such areas as the octave key, pads, and tone hole configurations, but the basic model endures. Today, the modern saxophone—most always made of brass—includes hundreds of individual parts and requires thousands of different manipulations before it is ready for playing.

The numerous parts and manipulations necessarily make the saxophone relatively expensive, and in the 1960s a plastic saxophone (the Grafton) was produced to offer an instrument which would be more affordable than one made of brass. The experimental saxophone, using metal pad cups, rods, and springs affixed to a plastic body, was limited to a production of sixty instruments, before the manufacturer went out of business. History does not record the invention or production of a keyless plastic saxophone.

Saxophones have also been made from bamboo, and today these instruments are manufactured by hand in tropical areas of the world where bamboo is in great abundance. Such instruments are usually made only in limited quantity, since they require great labor by individual artisans, and they are also subject to intonation problems, and related problems involving pitch, since they lack the quality control assured by modern manufacturing processes.

Various instrument makers and sellers whose instruments are comprised of a saxophone mouthpiece and attached reed coupled to a cylindrical body of plastic or wood have put forth claims that their instrument is a type of saxophone. Such instruments are not saxophones, however, since they lack a conically shaped bore. They are, instead, clarinets, or more accurately, chalameaus (folk clarinets which were first invented during the Renaissance).

OBJECTS AND ADVANTAGES

The purpose of the present invention is to provide a saxophone that would be affordable even to those of modest means. By eliminating the need for an expensive metal body, keys, rods, pads, springs, and other costly components of the traditional saxophone, the keyless plastic saxophone can be produced entirely by the extrusion process, thus eliminating the many man-hours needed to assemble a traditional saxophone and making it affordable to individuals with limited resources. At the same time, the keyless plastic saxophone's simple construction makes it extremely durable, as there are no moving parts to wear out.

Also, this invention offers a portability that is not possible in a traditional instrument. While the Bb plastic soprano saxophone, for example, weighs approximately ten ounces, a metal soprano weighs up to three pounds. In addition, the plastic saxophone's lack of delicate key work and pads allows it to be transported without requiring the kind of unwieldy and heavy case which is necessary to protect a traditional saxophone from damage.

Moreover, the keyless plastic saxophone is an ideal instrument for students of the recorder who desire a more sophisticated sound without having to relearn new lingering patterns and master a difficult system of keys, pads, and rods like those found on woodwind instruments such as the saxophone, flute, clarinet, and oboe. Since the keyless saxophone's fingerings are based on those of the recorder, students will find little difficulty in making the transition from the former to the latter. Additionally, the keyless saxophone is easily manipulated by children and adults with small hands, and its light weight, also, greatly increases its manageability for all individuals.

DRAWING FIGURES

Figure 2:
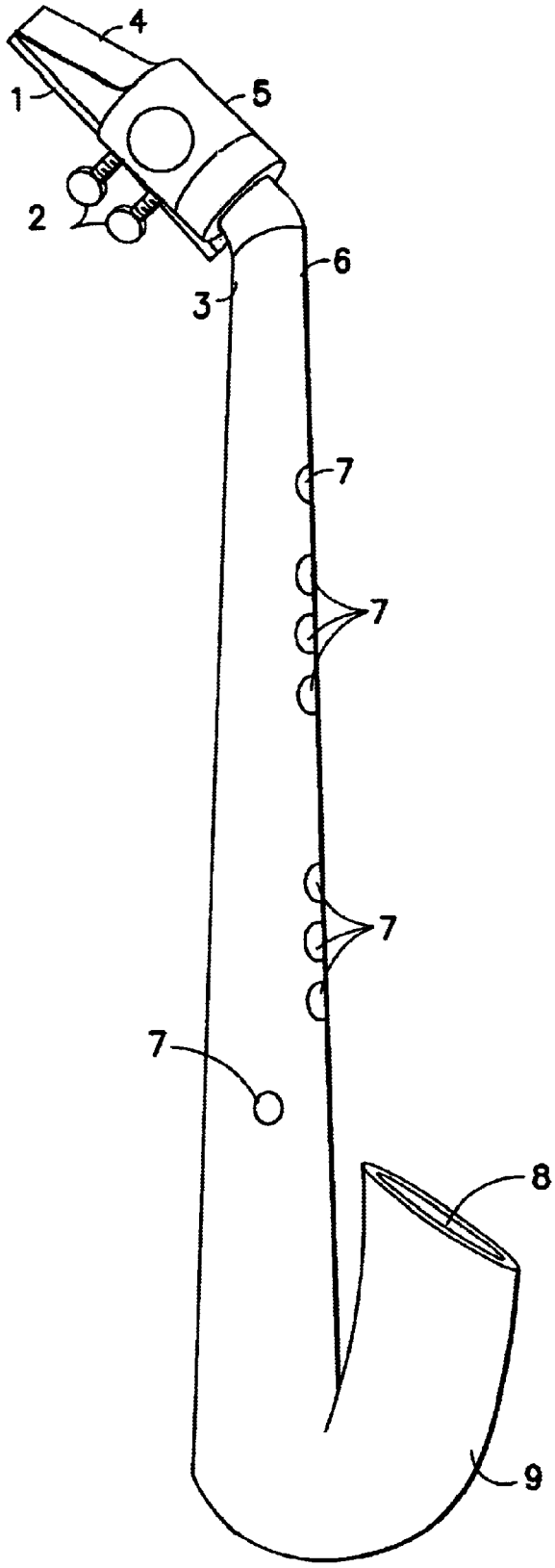
Figure 3:
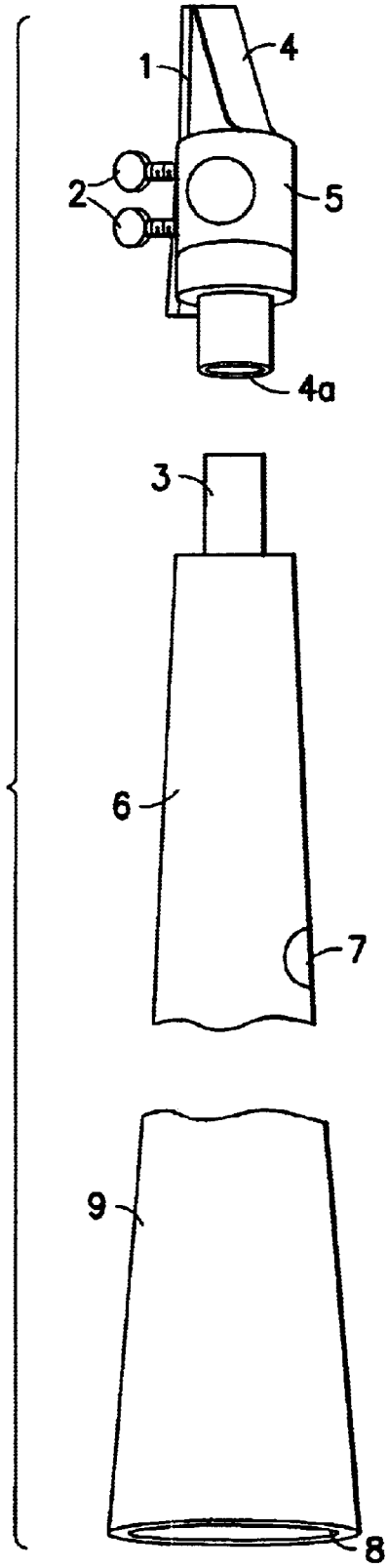

The advantages and characteristics of the keyless saxophone can be more easily understood through the description of the following drawings which shows in FIG. 1 a frontal view of the present invention as coupled to a standard soprano saxophone mouthpiece an showing the eight tone holes;

FIG. 2 a side view of the present invention, as it appears in a curved model; and FIG. 3 a cross section view showing the present invention's recessed neck, which is cylindrical on the outside and tapered on the inside, and also showing the internal and external taper of the instrument's body.

SUMMARY OF THE INVENTION

The keyless plastic saxophone consists of a conical body to which is affixed—at its narrow end—a soprano saxophone style mouthpiece, attached to which is a single reed secured by a metal or plastic ligature. The saxophone, which is also open at its widest end, has along its length eight tone holes. These tone holes can be opened and closed in various fingering patterns to change the pitch of the instrument, by altering the a standing sound wave initiated when the player's lips vibrate the reed. The fingering system, based upon that of the German and Baroque recorders (vertical flutes), is identical in all members of this particular saxophone family, and every member of the family has a basic range of one-and-a-half octaves (eighteen notes) with another eight notes made possible through the combination of various alternate fingerings. The twenty-six note possible range of the instrument compares favorably with the thirty-two note range of the traditional brass saxophone.

DESCRIPTION OF THE PREFERRED EMBODIMENTS—FIGS. 1 to 3

First Embodiment

Referring to FIG. 1 of the drawings, the key less plastic saxophone comprises a single reed 1, secured by thumb screws 2 and a metal or plastic ligature 5, to a standard soprano saxophone mouthpiece 4, which is coupled to a conical body 6, at its narrow end 3. The body of the instrument 6 has along its length a plurality of tone holes 7 (the location of which are calculated to produce a desired musical pitch. The musical pitch is produced when the player vibrates the reed 1 attached to the mouthpiece 4, which creates a standing wave inside the entire length of the instrument, from the mouthpiece 4 to the bell 9. The opening or closing of the tone holes 7 through various finger combinations based on the finger system of the Baroque recorder (or vertical flute) allows the playing of more than a full chromatic scale and a half (or twenty notes). The fundamental tone hole 8, set at a distance from the tip of the mouthpiece 4, determines the key in which the instrument is pitched. The present invention can be fabricated in models comprising the tenor, alto, soprano, and sopranino range.

Second Embodiment

Referring to FIG. 2 of the drawings, the present invention is depicted in a side-view and with a curved ("J-shaped) body, rather than the straight body illustrated in FIG. 1. With the exception of the curved bell 9, the embodiment of FIG. 2 is identical to the embodiment of FIG. 1, including the reed 1, the thumbscrews 2 for securing the reed 1, to the mouthpiece 4, the ligature which holds the reed to the mouthpiece 4, the neck of the instrument which couples to the mouthpiece 4, the conical body 6, with its plurality of tone holes 7, and the instrument's fundamental tone hole 8. The curved, "J-shaped" body affords the player easier access to the tone hole(s) 7 of the instrument when made in its larger forms as alto or tenor saxophones.

Third Embodiment

Turning to FIG. 3, the exterior of the keyless plastic saxophone comprises a conical bell 9, a conical body 6, and cylindrical neck 3 which fits inside the cylindrical chamber of a standard soprano mouthpiece. Since the exterior of the neck 3 is configured to fit snugly inside the rounded end of the mouthpiece 4*a*, the present invention obviates the need for the cork-sheathed neck of a traditional brass saxophone, thus lowering labor costs without compromising the integrity of the instrument. While the neck 3 is cylindrical on the exterior, it is tapered on the interior 3*a*. This taper continues through the interior of the body 6*a* and the bell 9*a* and ends at the fundamental tone hole 8. The present instrument thus preserves the characteristic saxophone sound generated when its internal taper acts on the sound wave generated by the player's vibration of the single-reed 1, secured to the mouthpiece 4 by a ligature 5 and thumb screws 2.

Conclusion

Since the basic sound of the saxophone is primarily determined by the taper and density of its conical body rather than by the materials used in its construction, the keyless plastic version of the instrument does not sacrifice richness of voice in its construction. Moreover,

- its simplicity makes possible an instrument that is affordable even to those of modest income;
- its light weight makes it highly portable;
- its plastic composition makes it extremely durable;
- its fingering system makes it easily learned by students of the recorder; and
- its lack of moving parts eliminates the need for costly repairs or for heavy cases to protect a delicate keywork like that found on traditional saxophones.

What is claimed:

1. A keyless, fully chromatic, saxophone capable of playing in all keys and having a range of two octaves, the saxophone comprising:

a) a soprano saxophone mouthpiece, comprising a reed;

b) a body, comprising a straight or curved tube, the tube having a wide end, a narrow end, a diameter, a length, and a key to which the keyless saxophone is pitched, the key determined by the length; wherein the body defines a conically shaped bore and a plurality of tone holes, the body is coupled to the mouthpiece at the narrow end of the tube, and the diameter of the tube increases along the length of the tube, such that, when a player blows through the mouthpiece, the reed vibrates, creating a standing wave in the tube, and a note of a standard twelve-tone chromatic scale is created.

2. The keyless saxophone according to claim 1, wherein the tone holes are configured and adapted to divert the standing wave at various points inside the instrument, such that, when at least one of the tone holes is opened or closed by a finger of the player, the note of the standard twelve-tone chromatic scale changes.

3. The keyless saxophone according to claim 1, wherein the bore has a degree of taper substantially the same as that of a standard, keyed soprano saxophone.

4. The keyless saxophone according to claims 1, wherein the mouthpiece is made of plastic or metal.

5. The keyless saxophone according to claims 1, further comprising interchangeable bodies to provide straight or curved keyless saxophones having a length that determines the key to which the keyless saxophone is pitched.

6. The keyless saxophone according to claim 5, wherein each interchangeable body, when attached to the soprano saxophone mouthpiece, provides one of a tenor, alto, soprano, sopranino, or sopranissimo keyless saxophone.

7. The keyless saxophone according to claim 5, comprising a body for a tenor keyless saxophone pitched in key selected from the group consisting of D, C, and Bb.

8. The keyless saxophone according to claim 5, comprising a body for an alto keyless saxophone pitched in key selected from the group consisting of Eb, E, F, F#, and G.

9. The keyless saxophone according to claim 5, comprising a body for a soprano keyless saxophone pitched in key selected from the group consisting of Ab, A, Bb, B, C, and C#.

10. The keyless saxophone according to claim 5, comprising a body for a sopranino keyless saxophone pitched in key selected from the group consisting of D, Eb, E, F, F# and G.

11. The keyless saxophone according to claim 5, comprising a body for a sopranissimo keyless saxophone pitched in key selected from the group consisting of Bb and C.

12. The keyless saxophone according to claim 1, wherein a middle portion of the soprano saxophone mouthpiece is covered by a metal ligature, which comprises a plurality of adjustable screws for securing the reed to the mouthpiece.

13. The keyless saxophone according to claim 12, wherein the ligature comprises 2 screws.

14. The keyless saxophone according to claim 1, wherein the body is plastic.

15. The keyless saxophone according to claim 1, wherein the mouthpiece comprises a single reed.

* * * * *